United States Patent [19]

Neumann

[11] 3,936,049

[45] Feb. 3, 1976

[54] TABLE TENNIS NET HOLDER

[75] Inventor: Rudolf Neumann, Breglink, Nubel, Germany

[73] Assignee: Heinz Kettler Metallwarenfabrik, Ense-Parsit, Germany

[22] Filed: June 13, 1974

[21] Appl. No.: 478,959

[30] Foreign Application Priority Data

June 13, 1973 Germany ..... 2330003

[52] U.S. Cl. ..... 273/30

[51] Int. Cl.² ..... A63B 39/00

[58] Field of Search ..... 273/30

[56] References Cited

FOREIGN PATENTS OR APPLICATIONS

| | | | |
|---|---|---|---|
| 717,369 | 10/1954 | United Kingdom | 273/30 |
| 959,083 | 2/1957 | Germany | 273/30 |

*Primary Examiner*—Richard C. Pinkham
*Assistant Examiner*—T. Brown
*Attorney, Agent, or Firm*—Walter Becker

[57] ABSTRACT

A table tennis net holder which includes a holding plate insertable into a transverse slot or gap of a sectional tennis table, and equipped with a post at its outer free end for connecting thereto one end of the tennis net. At least that inner portion of the holding plate which in mounted position of the holding plate is adjacent the tennis table is provided with a transverse web limiting the extent to which the holder can be slipped into the tennis table and has a T-profile, the vertical web of which is at its lower portion provided with clamping means, e.g. in the form of round elastic clamping members, on both sides of the vertical web. These clamping members are adjustable relative to the holding plate to take care of variations in the thickness of the tennis table to which the holder has to be fastened.

8 Claims, 2 Drawing Figures

TABLE TENNIS NET HOLDER

The present invention relates to a table tennis net holder which comprises a holding plate adapted to be inserted into a transverse slot in the table or into the gap between the two tennis table plates of a two-sectional table plate, which holding plate is at its outer free end provided with a post for connecting the end of the net thereto and at least at the inner end within the region adjacent the table plate is provided with a transverse web limiting the extent to which the holder can be placed onto the table and which is provided with a T-profile. At the vertical central web of said T-profile, the net holder is equipped with a clamping device engaging the bottom side of the table plate for connecting said net holder to the table plate.

It is an object of the present invention to provide a table tennis net holder of the above mentioned type with a particularly simple connecting device and to provide possibilities which permit to employ one and the same net holder for table plates of different thicknesses.

These objects and other objects and advantages of the invention will appear more clearly from the following specification, in connection with the accompanying drawings, in which.

The table tennis net holder according to the present invention is characterized primarily in that the central web of said tennis holder on a pin or shaft extending at both sides of the central web carries opposite the lateral web of the T-profile of the holding plate of said holder a clamping body while the central web for adaptation to different table plate thicknesses comprises a plurality of bores arranged at different distances from the lateral web of said T-profile, said shaft or pin being easily disconnectably connected to said central web.

Figure 1:
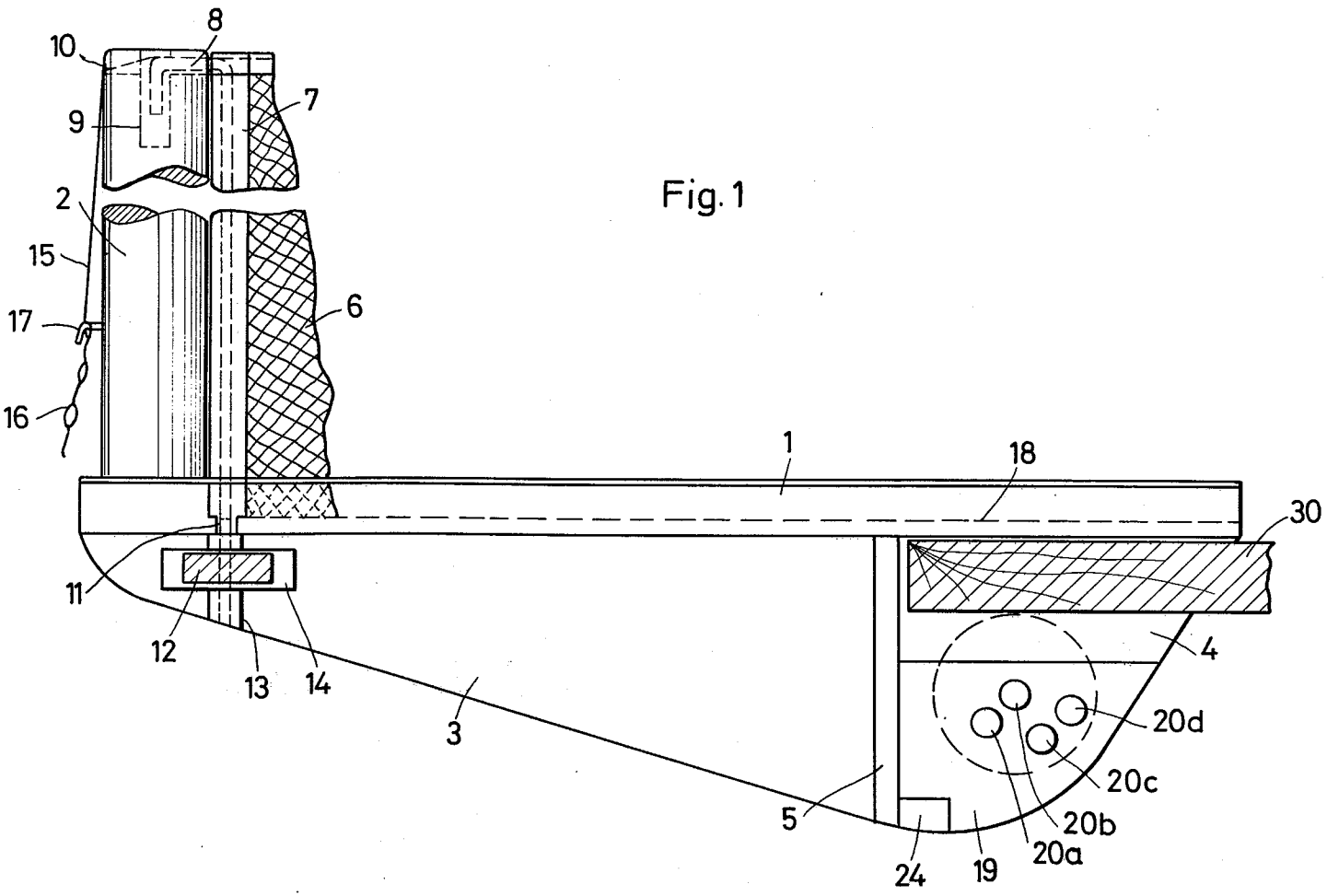
FIG. 1 is a diagrammatic side view of a net holder according to the present invention shown clamped onto the tennis table.

Referring now to the drawings in detail, the table tennis net holder according to the invention comprises a longitudinally extending holding plate 1 having its outer free end provided with a post 2 to which one end of the table tennis net 6 can be connected in any convenient manner. Provided at the bottom side of the holding plate 1 there is a vertical central web 3 for the outer range of the net holder which is separated from the vertical web 4 at the inner range of the net holder by a transverse web 5. The transverse web 5 limits the extent to which the net holder can be pushed onto the table plate 30 shown in section in FIG. 1. The table plate 30 may be a single plate in which instance it would be equipped with a transverse slot for receiving the web 4. If the table plate is a two-sectional table plate, the web 4 may be received in the slot or gap between the two plate sections.

The table tennis net 6 which is provided with a loop-shaped rim 7 is held by an arm 8 which has an L-shaped form with the L occupying a position upside down. The long portion of the arm 8 extends through the loop-shaped portion 7 of the net 6 and at its lower end rests in a bore 11 of the holding plate 1. The short end of the L-shaped arm 8 rests in a transverse slot 10 of the post 2 and engages an axial bore 9 of post 2. By means of a screw 12 received by a bore 13, the lower end of the arm 8 may in conformity with the desired height of the upper edge of the net be moved upwardly and downwardly. The screw 12 provided with a knurled surface is located in a rectangular recess 14 of the web 3 so as to protrude from said recess whereby it can easily be grasped and operated between two fingers.

The additional tensioning of the net 6 is effected in a customary manner by means of a cord 15 which extends over the entire surface edge of the net 6 and which rests on the arm 8 and in groove 10 and at its free end has chain links 16. The chain links 16 may be hooked onto a hook 17 which is located at the outside of the post 2. A longitudinal groove 18 in the holding plate 1 is adapted to receive the bottom edge of the net 6.

For purposes of connecting the net holder to the table plate 30 or to the table plate sections, there are provided clamping bodies **23*a* and 23*b* which preferably are designed as rubber rollers. The rubber rollers act like a cam and are supported by a screw bolt 21, the free end of which is provided with a nut 22 for axially compressing the rubber rollers 23*a* and 23*b***.

Figure 2:
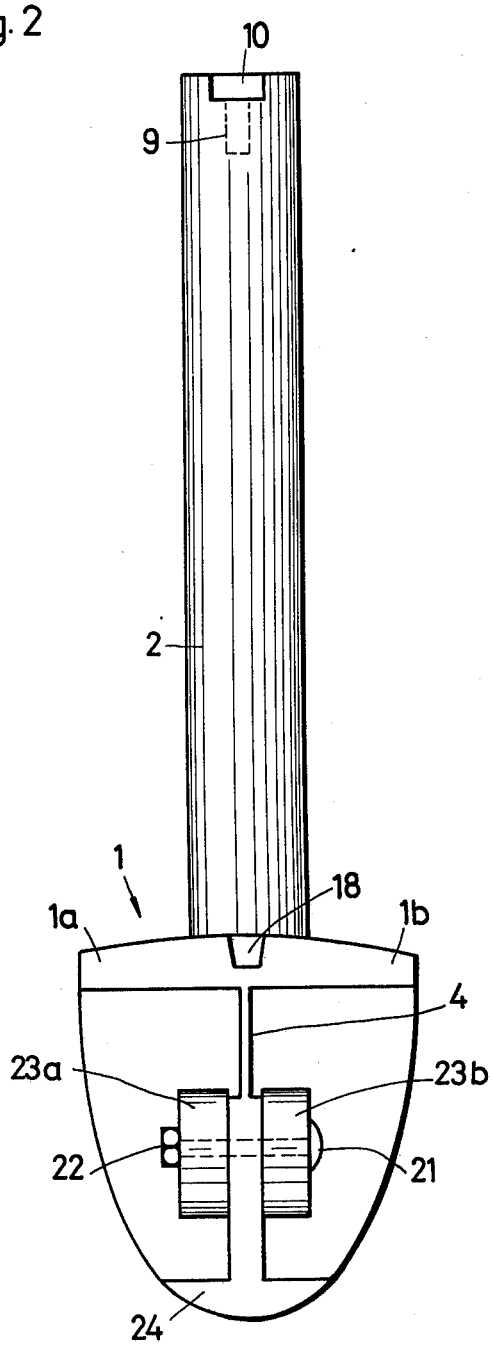
FIG. 2 is an end view of the net holder with a portion of the tennis table indicated in dot-dash lines.

As will be seen from FIG. 2, the outer end of the net holder has a T-profile which is formed by the two sections **1*a* and 1*b* of the holding plate and by the vertical central web 4. The central web 4 is within the region receiving the table plates 30 designed rather thin walled, but is somewhat thicker in the lower region at 19 so that the clamping rollers 23*a* and 23*b* can be safely held in their respective position by the screw 21. In order to be able to apply the net holder according to the present invention to table plates of different thicknesses, the central web 4 is, in its reinforced region 19, provided with a plurality of bores 20*a*, 20*b*, 20*c* and 20*d*, which are differently spaced from the bottom side of the lateral webs 1*a*, 1*b*. Depending on the respective thickness of the table plate, the respective bores 20*a*, 20*b*, 20*c* and 20*d* are selected. By a mere disengaging of the screw connection 21, 22, the clamping rollers 23*a* and 23*b* can quickly be changed as to their position and again by tightening the screw 21, 22** held in their respectively selected new position for tightening the net holder to the tennis table.

It is, of course, to be understood that the present invention is, by no means, limited to the specific showing in the drawings, but also comprises any modifications within the scope of the appended claims.

What I claim is:

1. A table tennis net holder for insertion into a transverse gap of a tennis table, which includes a longitudinally shaped holding plate having a top side and a bottom side and also having an outer section with an outer end face forming the outer end of said holding plate, a post extending upwardly from said top side near said outer end face for receiving and holding one end of the tennis net, said holding plate also having an inner section for extending across a portion of the width of a tennis table, abutment means arranged between said outer section and said inner section for abutment with one side of a tennis table to thereby limit the overlapping of a tennis table by said inner section, first and second web means respectively arranged below said outer and inner sections of said holding plate and extending at least approximately in a plane perpendicular thereto, supporting means extending through said second web means, and clamping means comprising at least one eccentrically operable member supported by said supporting means for pressing with camming action against an adjacent tennis table section when said holding plate occupies a desired effective position fastened on a tennis table.

2. A table tennis net holder for insertion into a transverse gap of a tennis table, which includes a longitudinally shaped holding plate having a top side and a bottom side and also having an outer section with an outer end face forming the outer end of said holding plate, a post extending upwardly from said top side near said outer end face for receiving and holding one end of the tennis net, said holding plate also having an inner section for extending across a portion of the width of a tennis table, abutment means arranged between said outer section and said inner section for abutment with one side of a tennis table to thereby limit the overlapping of a tennis table by said inner section, first and second web means respectively arranged below said outer and inner sections of said holding plate and extending at least approximately in a plane perpendicular thereto, supporting means extending through said second web means, and clamping means for pressing against an adjacent tennis table section when said holding plate occupies a desired effective position, said second web means being provided with a plurality of transverse bores, and said supporting means comprising a pin selectivity insertable into any of said bores for supporting said clamping means at different distances from the bottom side of said inner section.

3. A holder according to claim 2, in which said clamping means are designed as roller means.

4. A holder according to claim 3, in which said roller means consist of elastic rubber material.

5. A holder according to claim 2, in which said supporting means are designed as threaded bolts.

6. A holder according to claim 2, in which that portion of said second web means which is intended to receive a portion of a tennis table has a thickness which is less than the thickness of at least a part of the remaining portion of said second web means.

7. A holder according to claim 2, in which said holding plate has its top side provided with a longitudinal groove for receiving the lower rim portion of a tennis net to be held by said holder.

8. A holder according to claim 2, which includes holding means adjacent to said post for engaging the tennis net to be mounted and holding it at the desired height.

* * * * *